United States Patent [19]

McKenna

[11] Patent Number: 4,852,640

[45] Date of Patent: Aug. 1, 1989

[54] RECUPERATIVE HEAT EXCHANGER

[75] Inventor: Bruce A. McKenna, Toledo, Ohio

[73] Assignee: Exothermics-Eclipse Inc., Toledo, Ohio

[21] Appl. No.: 845,608

[22] Filed: Mar. 28, 1986

[51] Int. Cl.[4] ..... F24H 3/10; F28F 3/00

[52] U.S. Cl. ..... 165/47; 165/83; 165/135; 165/166; 165/901; 165/909

[58] Field of Search ..... 165/47, 83, 82, 166, 165/901, 909, 136, 145, 135

[56] References Cited

U.S. PATENT DOCUMENTS

| | | | |
|---|---|---|---|
| 1,597,479 | 8/1926 | Price . | |
| 1,648,646 | 11/1927 | Kobernik . | |
| 1,724,351 | 8/1929 | Henderson et al. . | |
| 1,750,850 | 3/1930 | Mantle et al. | 165/166 |
| 2,303,157 | 11/1942 | Bush | 165/121 |
| 2,336,879 | 12/1943 | Mekler | 165/83 |
| 2,462,421 | 2/1949 | Pitt . | |
| 2,526,135 | 10/1950 | Holmes et al. | 165/83 |
| 2,553,030 | 5/1951 | Bell | 165/166 |
| 2,653,799 | 9/1953 | Stahn et al. | 165/83 |
| 2,670,185 | 2/1954 | Schorner et al. | 165/83 |
| 2,699,322 | 1/1955 | Feldstein . | |
| 2,875,986 | 3/1959 | Holm | 165/145 |
| 2,941,787 | 6/1960 | Ramer | 165/166 |
| 3,225,823 | 12/1965 | Frohlich | 165/95 |
| 3,398,787 | 8/1968 | Bevevino . | |
| 3,494,414 | 2/1970 | Warner . | |
| 3,627,035 | 12/1971 | Astrup . | |
| 3,643,733 | 2/1972 | Hall et al. . | |
| 3,986,549 | 10/1976 | Huggins et al. . | |
| 4,050,628 | 9/1977 | Konnerth, III | 165/901 |
| 4,113,007 | 9/1978 | Flower et al. . | |
| 4,131,159 | 12/1978 | Long | 165/166 |
| 4,453,592 | 6/1984 | Wightman | 165/83 |
| 4,461,344 | 7/1984 | Allen et al. | 165/909 |
| 4,505,329 | 3/1985 | Nguyen-Thanh . | |
| 4,541,480 | 9/1985 | Beckmann . | |

FOREIGN PATENT DOCUMENTS

| | | | |
|---|---|---|---|
| 2362356 | 3/1978 | France | 165/909 |

*Primary Examiner*—John Ford

*Attorney, Agent, or Firm*—Emch, Schaffer, Schaub & Porcello Co.

[57] ABSTRACT

A recuperative heat exchanger having a heat exchanger core composed of a plurality of spaced apart plate members is disclosed. The core is disposed for receiving high temperature exhaust gases. A case member is positioned around the heat exchanger core. The case member has an exhaust gas inlet opening and an exhaust gas discharge opening. The plates of the core are secured to the case member at the exhaust gas inlet opening. A jacket is positioned in a spaced apart relationship around the case member. The jacket has an intake opening and an exhaust opening. The intake opening of the jacket is in alignment with the exhaust gas inlet opening of the case member and the exhaust opening in the jacket is in alignment with exhaust gas discharge opening in the case member. The case member is secured to the jacket at the exhaust gas discharge. The core and case member of the heat exchanger are capable of expansion and contraction in the jacket during the operation of the heat exchanger. Expansion joints are also provided in the case member to facilitate expansion of the heat exchanger core and case member during operation of the heat exchanger.

27 Claims, 5 Drawing Sheets

RECUPERATIVE HEAT EXCHANGER

BACKGROUND OF THE INVENTION

This invention relates to a plate-type recuperative heat exchanger. In this heat exchanger hot exhaust gases are directed through a first plurality of passageways formed by the plate in the core of the heat exchanger. Supply air is directed through a second set of passageways defined by the plates of the heat exchanger to recover heat from the exhaust gases. The supply air is directed through the core of the heat exchanger in a direction that is substantially opposite to the direction of flow of the exhaust gases. This recuperative heat exchanger is designed to be used for high temperature applications where the temperature of the exhaust gases can be as high as 1500° F.

In the past recuperative heat exchangers have been used to recover energy from exhaust gases so that this energy can be reused in other processes. Platetype heat exchangers are commonly used for achieving an indirect heat transfer between two circulating fluids at different temperatures. These heat exchangers generally consist of a plurality of spaced parallel plates welded or otherwise attached between two end plates to define parallel passages. Manifolds are attached to the ends of the passages to direct each fluid to alternate passages so that each plate forms a heat conducting interface between the two fluids. However, there is difficulty when utilizing such heat exchangers for high temperature applications. The stresses incurred by the expansion and contraction of the components of the heat exchanger during use can result in a failure of the recuperative heat exchanger. Because of structural limitations, this type of heat exchanger unit is not suitable for high temperature installations. Accordingly, a lot of heat energy was wasted because it was not possible to use such heat exchangers at the areas of high temperature where the most energy can be recovered. Accordingly, it is an object of the present invention to provide a recuperative-type heat exchanger to be used in high temperature applications.

It is a further object of the invention to provide a recuperative-type heat exchanger where the plates that form the core of the heat exchanger are free to expand and contract during the operation of the heat exchanger.

It is an object of the invention to provide a recuperative heat exchanger having a high efficiency.

Other objects and advantages of the invention will be apparent from the following detailed description of the invention.

SUMMARY OF THE INVENTION

The invention is directed to a recuperative heat exchanger having a heat exchanger core composed of a plurality of spaced apart plate members. The core is disposed for receiving high temperature exhaust gases. A case member is positioned around the heat exchanger core. The case member has an exhaust gas inlet opening and an exhaust gas discharge opening. The plates of the core are secured to the case member at the exhaust gas inlet opening. A jacket is positioned in a spaced apart relationship around the case member. The jacket has an intake opening and an exhaust opening. The intake opening of the jacket is in alignment with the exhaust gas inlet opening of the case member and the exhaust opening in the jacket is in alignment with exhaust gas discharge opening in the case member. The case member is secured to the jacket at the exhaust gas discharge opening. The core and case member of the heat exchanger are capable of expansion and contraction in the jacket during the operation of the heat exchanger. Expansion joints are also provided in the case member to facilitate expansion of the heat exchanger core and case member during operation of the heat exchanger.

DESCRIPTION OF THE PREFERRED EMBODIMENT

The invention is directed to a plate-type recuperative heat exchanger. More specifically, the invention is directed to a high temperature heat exchanger with built-in expansion and contraction capabilities. The features of the invention will be more fully understood by referring to the attached drawings in connection with the following description.

Figure 1:
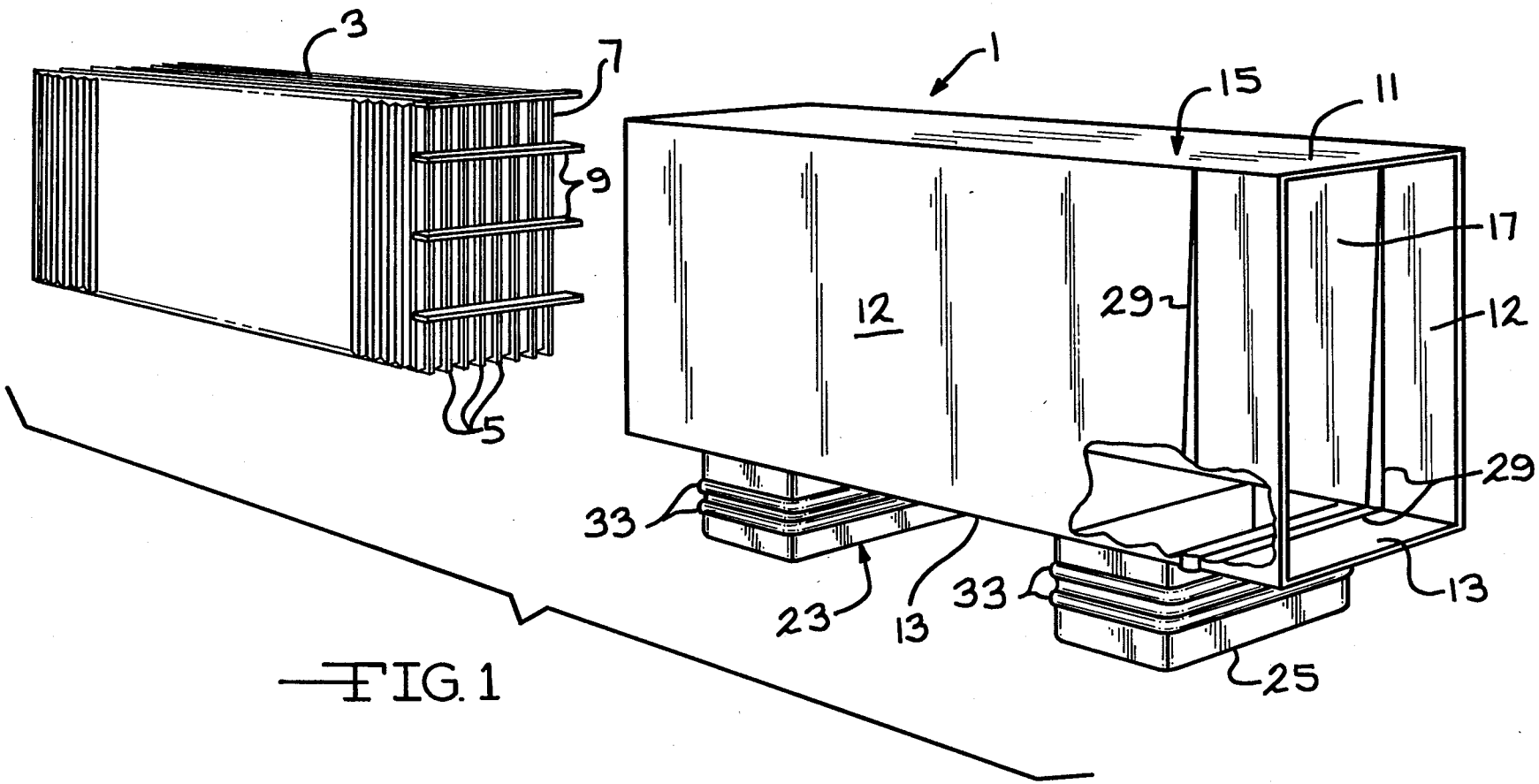
FIG. 1 is an expanded perspective view of components of the recuperative heat exchanger.
Figure 2:
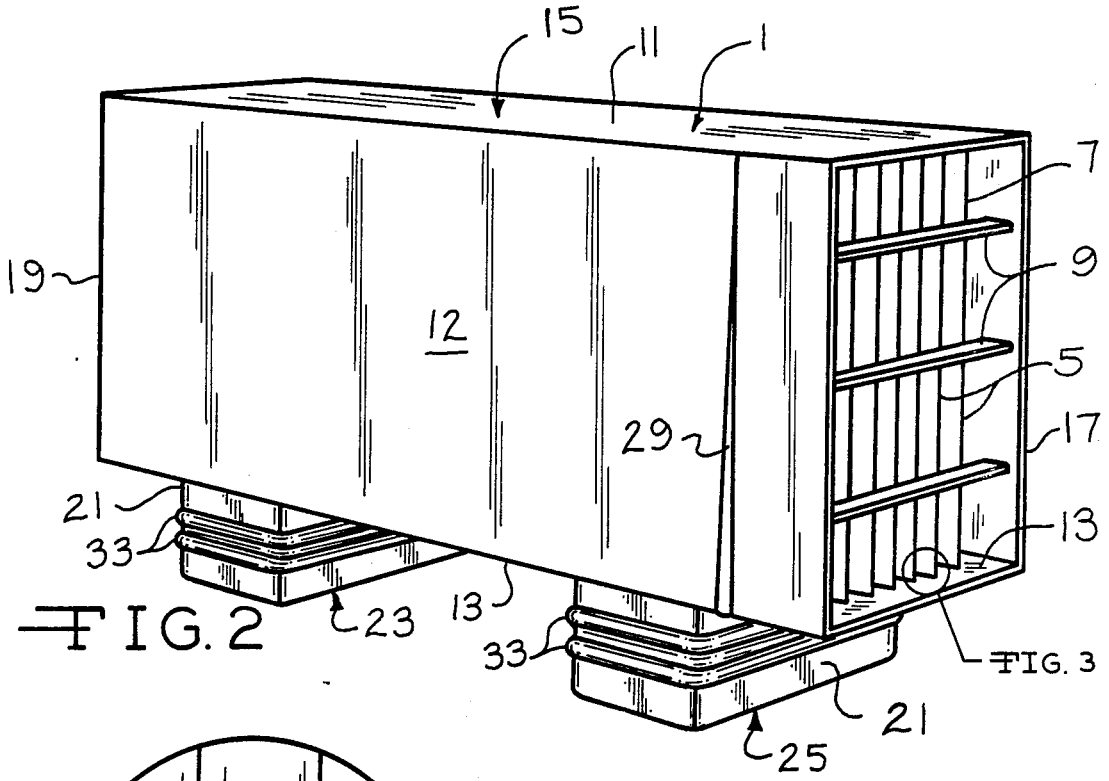
FIG. 2 is a perspective view of a portion of the recuperative heat exchanger.
Figure 10:
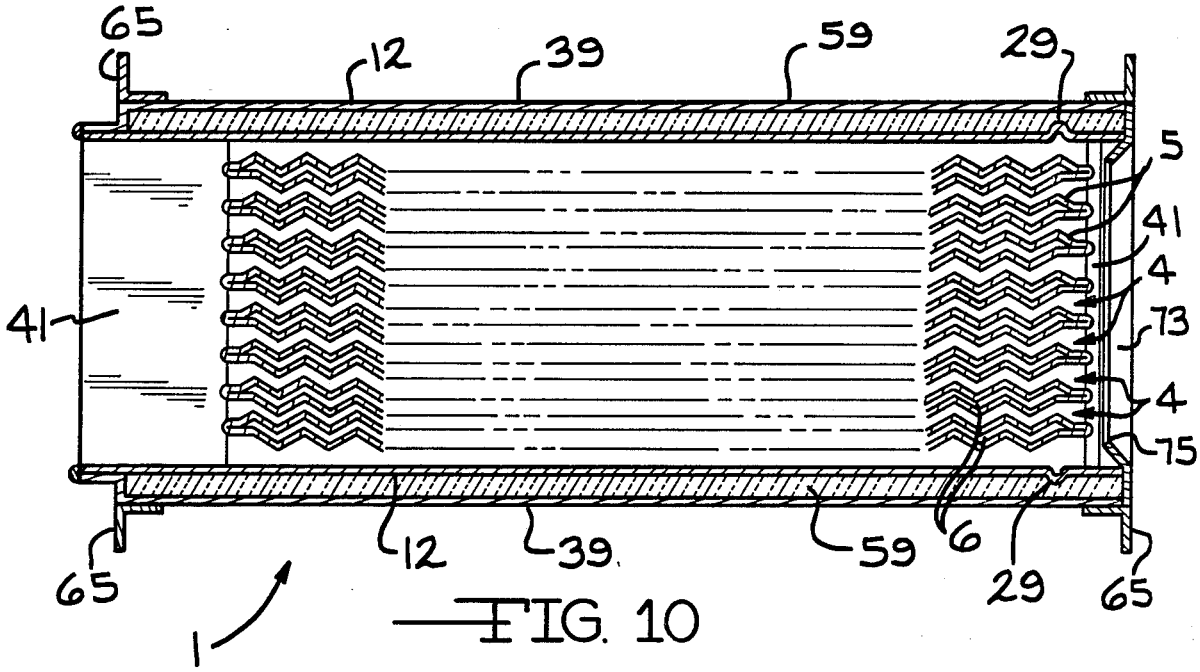
FIG. 10 is a cross-sectional view taken along line 10—10 in FIG. 9.
Figure 11:
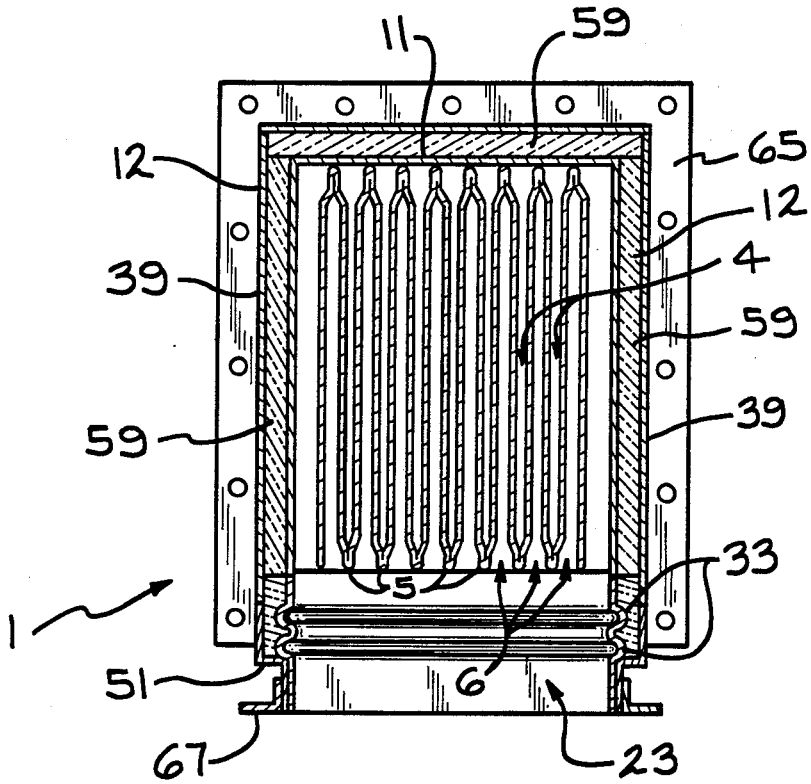
FIG. 11 is a cross-sectional view taken along line 11—11 in FIG. 9.

The recuperative heat exchanger 1 has a core 3 composed of a plurality of spaced apart corrugated shaped plate members 5. The plate members 5 define a first plurality of passageways 4 as seen in FIGS. 1 and 10, and a second plurality of passageways 6 as seen in FIGS. 1 and 11. The first plurality of passageways 4 formed by the corrugated plate members are disposed for receiving high temperature exhaust gases that pass through the exchanger in one direction. The plate members 5 of the core 3 are made of any high nickel alloy steel that is capable of withstanding high temperatures. In practice it has been found that 309-type stainless steel worked particularly well for the plate members. On the first end 7 of the core 3 there are located a plurality of reinforcing bars 9 that provide addition strength at the first end 7 or the core 3 and provide a means for retaining the spacing between the plate members 5 of the core 3. To allow heat transfer across the plate members 5, it is necessary that they are made of relatively thin material to facilitate this heat transfer. The plate members 5 of the core 3 are usually formed from a high temperature alloy having a thickness from about 28 gage to about 24 gage. In practice it has been found that using material having a thickness of substantially 26 gage works particularly well in providing plate member 5 that have enough strength to properly function as the core of the heat exchanger while being thin enough to readily allow heat to be transferred through the plates of the core. Although examples of materials and thickness of materials have been given for the plates 5 of the core, it should be understood that these examples are not meant to be limiting. Other materials and thicknesses can be used depending on the size and intended area of use for the heat exchanger.

Figure 3:
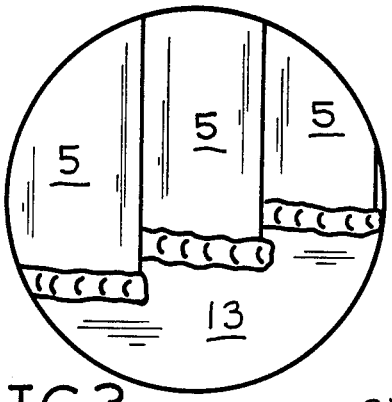
FIG. 3 is an exploded perspective view of a portion of the recuperative heat exchanger shown in FIG. 2.

Positioned around the heat exchanger core 3 is a case member 15. The case member 15 has a top 11, two substantially parallel sides 12, a bottom 13, an exhaust gas inlet opening 17 and an exhaust gas discharge opening 19. The exhaust gas inlet opening and the exhaust gas discharge opening are disposed in opposed substantially parallel relationship at opposite ends of the case member. The first plurality of passageways 4 formed by the plates 5 extend between the exhaust gas inlet opening 17 and the exhaust gas discharge opening 19. The exhaust gas inlet opening 17 and the exhaust gas discharge opening 19 are positioned so that high temperature exhaust gases can move through the first plurality of passageways 4 formed by the plates of the heat exchanger from the exhaust gas inlet opening to the exhaust gas discharge opening. The core 3 of the heat exchanger 1 is positioned so that the first end 7 of the core is positioned adjacent the exhaust gas inlet opening 17 of the case member 15. The second end 8 of the core 3 is positioned so that it is adjacent the exhaust gas discharge opening 19 of the case member 15. The core 3 is secured to the case member 15 in the area of the exhaust gas inlet and discharge openings. A spray deposit welding technique is used to secure the core to the case member as shown in FIG. 3. This spray deposit welding technique is described in U.S. Pat. No. 4,541,480 and the teachings of this patent with regard to this spray deposit welding technique are incorporated by reference into this patent application. Thus, the plate members 5 of the core 3 are securely attached to the case member 15 at the ends of the case member 15.

On the bottom of the case member 15 are two projections 21 that extend from the case member in a direction away from the core 3. The ends of projections 21 that are spaced apart from case member 15 define openings. One projection contains supply air inlet opening 23 and the other projection supply discharge opening 25. The supply air inlet and supply discharge openings are positioned to be substantially perpendicular to the exhaust gas inlet and discharge openings at the ends of the case member 15. The supply air inlet opening 23 is positioned adjacent the exhaust gas discharge opening 19. The supply air discharge opening 25 is positioned adjacent the exhaust gas inlet opening 17. The supply air inlet and discharge opening are in communication with the second plurality of passageways 6 defined by the plate members 5, as shown in FIG. 11. The supply inlet and discharge openings are positioned to allow supply air to enter the case member 15, pass through the second plurality of passageways 6 in the core 3 and then be discharged from the case member 15.

An expansion joint 29 is positioned in the case member 15 adjacent the exhaust gas inlet opening 17. The expansion joint 29 can extend around the entire periphery of the case member and be disposed substantially parallel to the exhaust gas inlet opening 17. However, in practice it has been found preferable to have the expansion joint extend around only a portion of the periphery of the case member. In this configuration the expansion joint is located on the bottom 13 of the case member 15 that is adjacent the supply air discharge opening 25 and extends along each side 12 of the case member 15. The expansion joint 29 is disposed substantially parallel to the exhaust gas inlet opening 17 in the case member 15. Thus, the expansion joint has a substantially U-shape configuration on one end of the case member 15. The expansion joint is formed by making a substantially semi-circular groove in the case member 15. The groove is positioned so that it extends away from the core 3 located in the interior of the case member 15. In practice it has been found that a groove having a diameter from about ¼ of an inch to about 2 inches will work well in allowing the case member 15 to expand and contract during the operation of the heat exchanger. It has also been found useful to have the expansion joint 29 taper or converge as it advances along the sidewalls of the case member 15 in a direction away from the bottom 13 of the case member 15 and the supply air discharge opening 25. As the expansion joint reaches the top 11 of the case member 15 the expansion joint terminates at this surface of the case member 15. There are also two expansion joints 33 positioned in the projection 21 that defines the supply inlet opening 23 and the projection 21 that defines the supply air discharge opening 25. The expansion joints 33 are substantially semicircular grooves positioned around the periphery of the projections 21. The expansion joints 33 are disposed to be substantially perpendicular to the expansion joint 29 in the case member 15. The expansion joints 33 are substantially semicircular grooves that have a diameter from about ¼ of an inch to about 2 inches and the grooves are disposed so that they extend away from the interior of the supply air inlet and discharge openings. In practice it has been found that having two expansion joints on the projection 21 defining the supply air inlet opening and two expansion joints on the projection 21 defining the supply air discharge opening provides an adequate degree of expansion and contraction on this portion of the case member during operation of the heat exchanger. However, it should be recognized that any number of expansion joints that provide the desired level of expansion and contraction could be utilized on the projections 21. The expansion joints 33 are positioned so that they are substantially perpendicular in relationship and substantially parallel to the flow of supply air through the supply air inlet and supply air discharge openings.

To reduce the differential in thermal expansion and contraction between the case member 15 and the core 3 it is desirable to have the case member formed of a high temperature alloy material essentially the same as used for the plates 5 and having a thickness that is not much greater than the thickness of the material used to form the plates 5 in the core 3. However, it is desirable to increase the thickness of the material used to form the case member 15 to provide additional strength and support in the case member which in turn provides additional strength and support for the plates 5 of the core 3 located within the case member 15. Accordingly, it has been found that a case member using material having a thickness from about 22 gage to about 18 gage will work well in providing a case member that has acceptable expansion and contraction characteristics. In practice it has been found that using a material for the case member 15 that has a thickness of 20 gage works particularly well when using a material for the plates 5 that has a thickness of 26 gage. Although examples of materials and thickness of materials have been given for the case member 15 other thicknesses and materials can be used depending on the size and intended use of the heat exchanger. However, to provide acceptable expansion and contraction characteristics, and acceptable strength it is preferable to have the material forming the case members 15 to be from about 1½ to about 3 times the thickness of the material used to form the plate members 5 in the core 3.

Figure 6:
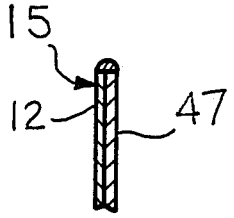
FIG. 6 is a cross-sectional view taken along line 6—6 shown in FIG. 5.
Figure 7:
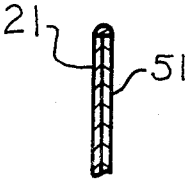
FIG. 7 is a cross-sectional view taken along line 7—7 shown in FIG. 5.
Figure 5:
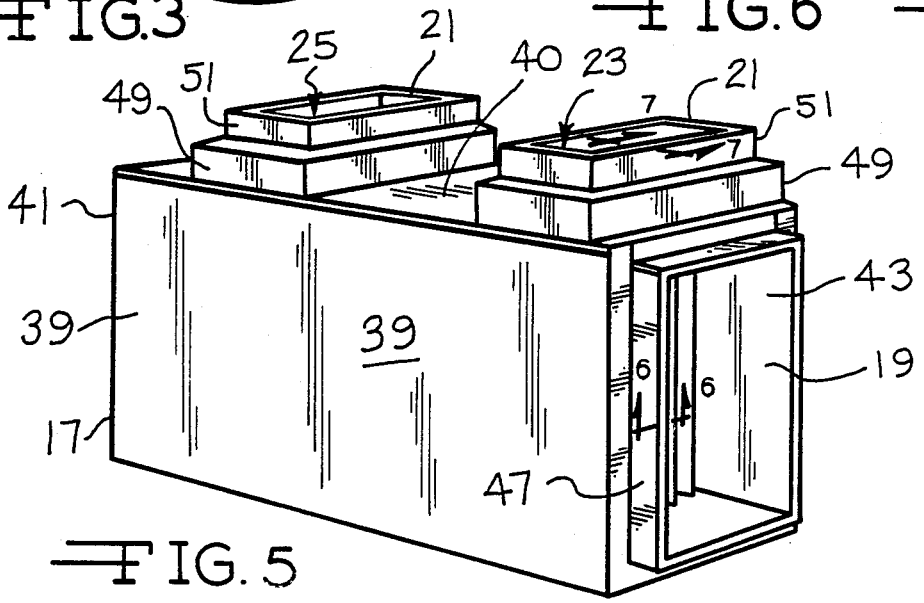
FIG. 5 is a perspective view showing the assembled recuperative heat exchanger.
Figure 4:
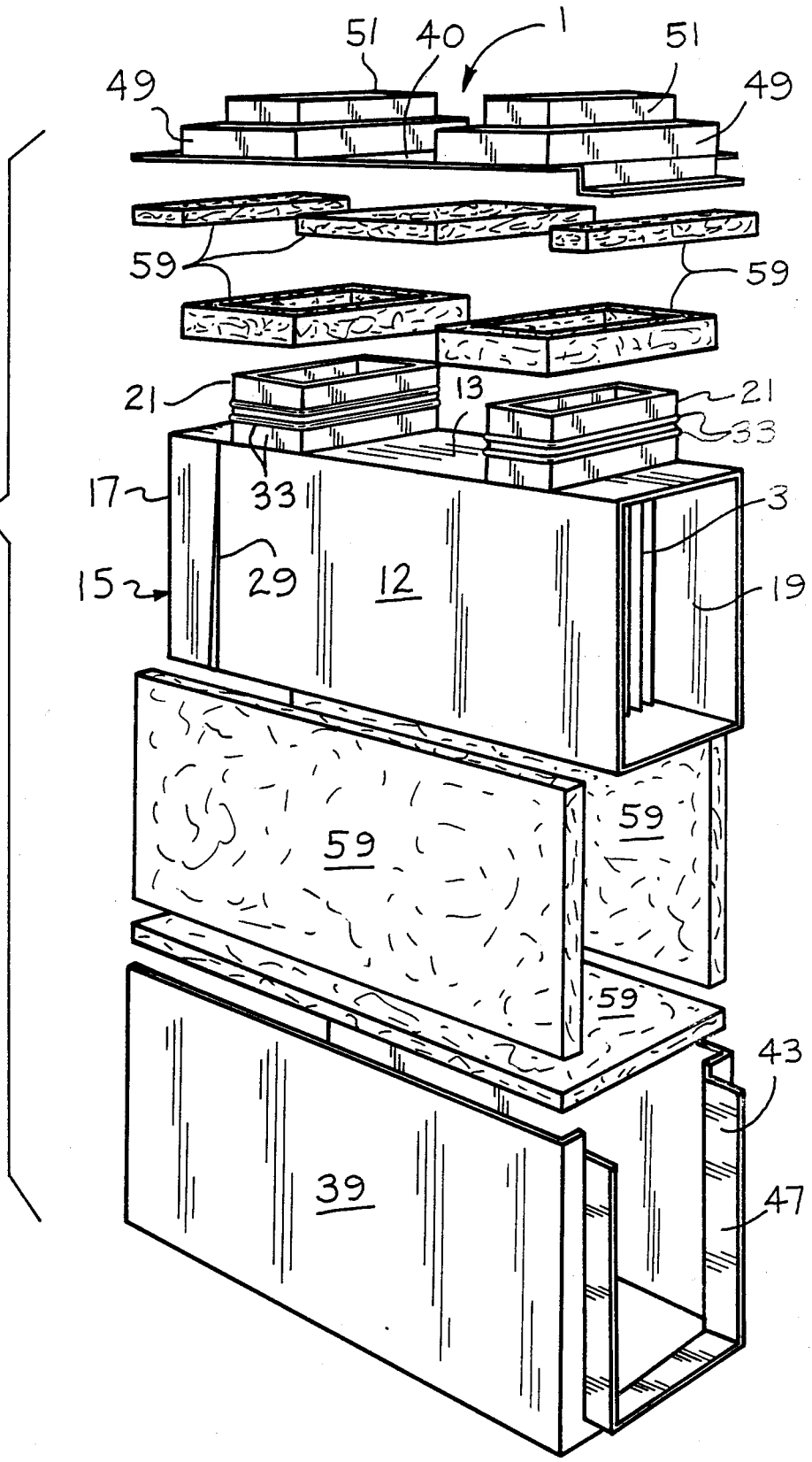
FIG. 4 is an expanded perspective view showing the assembly of components of the recuperative heat exchanger.
Figure 8:
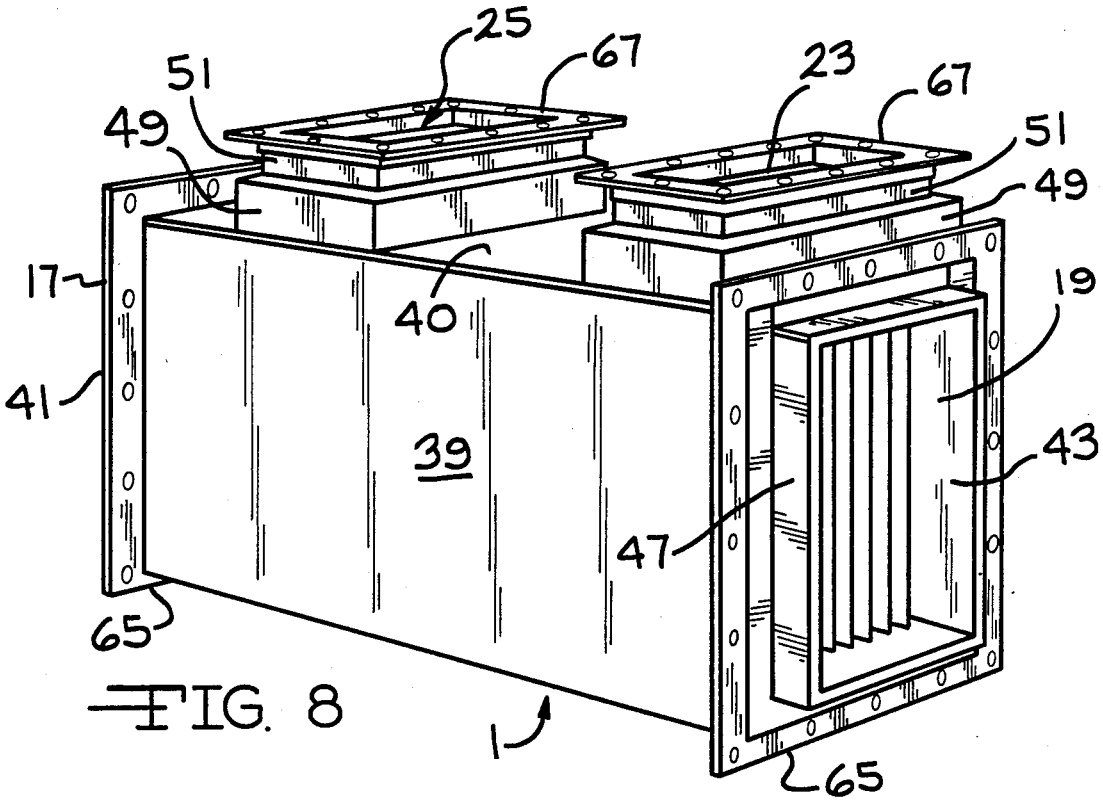
FIG. 8 is a perspective view of the heat exchanger.

Referring now to FIGS. 4 and 5, positioned around the case member 15 is a jacket 39. The jacket 39 is positioned in spaced apart relationship with the case member 15. In most applications the jacket 39 is spaced approximately 1 inch from the case member. The jacket 39 has an intake opening 41 and an exhaust opening 43. The intake opening 41 is positioned in alignment with the exhaust gas inlet opening 17 in the case member 15. The exhaust opening 43 is in alignment with the exhaust gas discharge opening 19 in the case member 15. A section 47 of the jacket 39, adjacent the exhaust opening 43, is positioned in abutting relationship around the exhaust discharge opening 19 in the case member 15. The section 47 of the jacket 39 is welded to the case member 15 as shown in FIG. 6 to secure the case member to the jacket 39. The jacket 39 also extends around the projections 21 that form the supply air inlet opening 23 and the supply air discharge opening 25. An extension 49 of the jacket 39 is positioned in spaced apart relationship around the portion of the projections 21 that contain the expansion joints 33. The jacket 39 then steps in towards the projections to a flange 51 that is positioned in abutting relationship around the portion of the projections that are spaced apart from the case member 15. The flange 51 is welded to the projections 21 that form the supply air inlet and discharge openings as shown in FIG. 7. This secures the jacket 39 to the projections 21 to assist in securing the case member 15 to the jacket 39.

The material that forms the jacket 39 must supply the primary structural strength for the recuperative heat exchanger 1 and act to protect the core 3 and case member 15 of the heat exchanger. Accordingly, it has been found that using a high nickel alloy steel having a thickness from about 13 gage to about 9 gage will work well with a core and case member made of the materials as previously described. In practice, it has been found that 309 stainless steel having a thickness of 11 gage will work particularly well for this type of recuperative heat exchanger. It should be understood that other materials and thicknesses of material can be used to accommodate various size heat exchanger and heat exchangers that are to function in a particular environment. However, it has been found that it is desirable to have the material for the jacket 39 having a thickness that is from about 1½ to about 5 times the thickness of the material used for the case member 15 to provide adequate strength for the jacket while maintaining an acceptable coefficient of expansion and contraction.

A filler material 59 is positioned in the space between the jacket 39 and the case member 15. The filler material acts to maintain the desired substantially uniform spacing between the case member and the jacket. The filler material is normally made of a high density fibrous-type material that also provides insulation between the case member 15 and the jacket 39.

FIG. 4 shows the assembly method for the recuperative heat exchanger 1. The top and two sides of the jacket 39 form a substantially U-shaped receptacle. The filler material 59 is positioned on the top and two sides of the substantially U-shaped receptacle formed by the jacket 39. The case member 15 with the core 3 secured in place is then positioned in the U-shaped portion of the jacket 39 so that the filler material 59 is between the jacket and the case member. The filler material 59 is then positioned around the projections 21 in the case member 15 that form the supply air inlet and discharge openings and filler material is also positioned on the bottom surface 13 of the case member 15 that is adjacent the open side of the jacket 39. The last side or bottom of the jacket 39 is then positioned over the bottom 13 of the case member 15 and around the projections 21 in the case member 15. This section of the jacket 39 is then secured to the remainder of the jacket to totally enclose the case member 15 and the core 3. The section 47 of the jacket 39 can then be secured to the case member 15 as shown in FIG. 6 and the flange 51 of the jacket 39 can be secured to the projections 21 as shown in FIG. 7.

The plate member 5 of the core 3 are secured to the case member 15 at the exhaust gas inlet and discharge openings. The case member 15 is secured to the jacket 39 at the section 47 that is adjacent the exhaust opening 43 in the jacket and where the portions 51 are secured to the projections 21 that form the supply air inlet and discharge openings. Since the case member 15 is only secured at these three points, the case member and core can expand and contract within the jacket 39. There is an expansion joint 29 positioned in the case member 15 and expansion joints 33 positioned in the projections 21 that form the supply air inlet and discharge openings. These expansion joints also assist in allowing the case member 15 to expand and contract within the jacket 39.

Referring now to FIGS. 8–11, connecting flanges 65 are connected to the jacket 39 adjacent the intake opening 41 and the exhaust opening 43. The connecting flanges 65 allow the recuperative heat exchanger 1 to be connected to other process equipment so that hot exhaust gases can be supplied to the intake opening 41 and these exhaust gases discharge from the recuperative heat exchanger through the exhaust opening 43. A mounting flange 67 is also connected to the flange 51 of the jacket 39 and the projections 21 that form the exhaust gas inlet and discharge openings. The mounting flanges 67 allow the recuperative heat exchanger 1 to be connected to additional process equipment to allow supply air to be directed to the heat exchangers through the supply air inlet opening 23 and discharge from the supply air discharge opening 25. Normally, a flexible-type expansion joint will be positioned between the flanges connecting 65 and the other process equipment and a similar flexible expansion joint will be positioned between the mounting flanges 67 and the additional process equipment used to supply the supply air to the recuperative heat exchanger.

Figure 9:
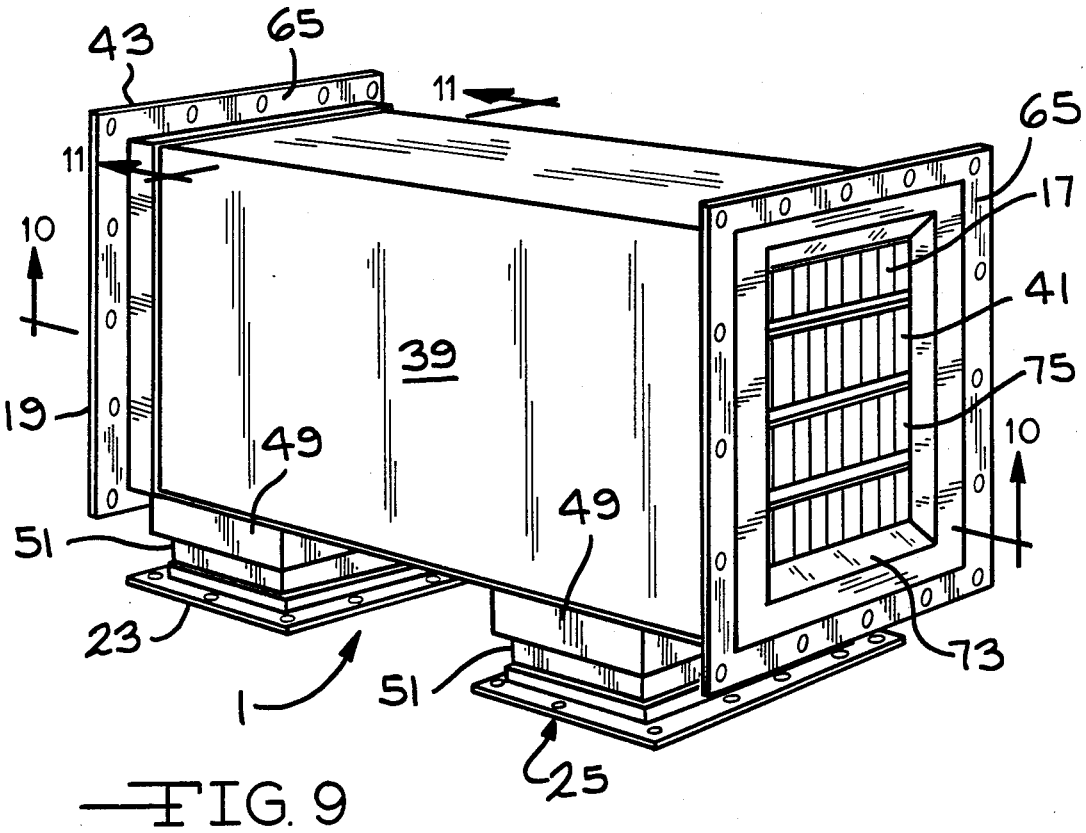
FIG. 9 is a side perspective view of the heat exchanger.

Referring now to FIGS. 9 and 10, positioned on the intake opening 41 of the jacket 39 is a deflector member 73. The deflector member 73 is secured to the jacket 39 by means of welding or other securing means. The deflector member extends into the intake opening 41 and over the filler material 59 that is located between the case member 15 and jacket 39 at this end of the recuperative heat exchanger 1. The deflector member 73 forms an opening 75 that is in alignment with the exhaust gas inlet opening 17 in the case member 15. The deflector member 73 acts to channel the hot exhaust gases to the first plurality of passageways 4 in the plate members 5 of the core 3 and to keep the exhaust gases from being directed into the filler material 59. The deflector member 73 also directs the hot exhaust gases away from the welds where the plates 5 are secured to the case member 15 (see FIG. 3). The deflector member 73 is not secured to the case member 15 or the core 3 and does not provide any interference to the expansion and contraction of the case member or the core.

In operation, hot exhaust gases are directed into the intake opening 41 in the jacket 39 of the recuperative heat exchanger 1. The deflector member 73 ensures that the hot exhaust gases are directed into the exhaust gas inlet opening 17 in the case member 15. This directs the exhaust gases through the first plurality of passageways 4 in the plate members 5 in the core 3 of the heat exchanger. The exhaust gases are discharged from the heat exchanger 1 through the exhaust gas discharge opening 19 in the case member 15. The exhaust gas discharge opening 19 is located in the exhaust opening 43 in the jacket 39. The exhaust gases pass through the first plurality of passageways 4 formed by the plate members 5 and the exhaust gases pass in a substantially straight path from the intake opening 41 through to the exhaust opening 43. The recuperative heat exchanger is designed to handle very high temperature exhaust gases and the unit is capable of handling exhaust gases up to 1500° F.

To recover heat from the exhaust gases that are passing through the recuperative heat exchanger 1, supply air is introduced through supply air inlet opening 23 on one side of the heat exchanger. The supply air inlet opening 23 is positioned adjacent the exhaust opening 43 in the jacket 39. The supply air passes through the inlet opening 23 and into the second plurality of passageways 6 defined by the plate members 5 in the core 3. The supply air is removed from the core 3 through the supply air discharge opening 25. The supply air discharge opening 25 is positioned adjacent the inlet opening 41 in the jacket 39. Thus, the supply air moves through the heat exchanger core in a direction that is generally opposite to the direction of travel of the high temperature exhaust gases.

An example of how the recuperative heat exchanger 1 would function will demonstrate the beneficial energy recovery that can be obtained by such a high temperature unit. Hot exhaust gases, having a temperature of about 1500° F. are introduced into the intake opening 41 in the jacket 39. These high temperature exhaust gases pass through the first series of passageways 4 defined by the plate member 5 in the core 3. At the same time, ambient temperature supply air is introduced through supply air inlet opening 23. This ambient temperature air has a temperature from about 70° F. to about 80° F. As the hot exhaust gases pass through the first series of passageways 4 in the plate members 5, heat is transferred to the supply air which is passing in the opposite direction through the second plurality of passageways defined by the plate members 5. When the exhaust gases are discharged through exhaust opening 43 in the jacket 39, the temperature will be approximately 500° F. Accordingly, there has been a drop in the temperature of the exhaust gases of approximately 1000° F. as the exhaust gases pass through the recuperative heat exchanger 1. The supply air that is removed from the heat exchanger through the supply air discharge opening 25 will have a temperature from about 600° F. to about 1000° F. Thus, the supply air will be substantially heated from the energy contained in the hot exhaust gases and the supply air can be used in other processes requiring heated air. Thus, a great deal of heat energy has been recovered that can be reused in other processes.

The high temperature exhaust gases introduced into the recuperative heat exchanger 1 transfers a great deal of heat to the plate members 5 in the core 3 into the case member 15. This heat transfer causes the plates 5 to expand and contract during the operation of the heat exchanger. Most of the expansion and contraction of the core is in the axial direction along the length of the case member 15. However, these is also expansion and contraction in other directions and the heat exchanger is designed to accommodate the expansion and contraction in all directions. When the high temperature exhaust gases are introduced into the recuperative heat exchanger, the plate members 5 can expand and increase in length along with the case member 15. When the hot exhaust gases are no longer supplied to the recuperative heat exchanger, the plate members 5 are free to contact and shrink in length with the case member 15. As the case member 15 surrounds the core 3, there will also be a great deal of heat transfer into the material of the case member. The case member is only secured to the jacket 39 at the exhaust opening 43 and at the projections 21 and the case member is also be free to expand and contract as appropriate during the use of the recuperative heat exchanger. The expansion joint 29 positioned in the case members 15 adjacent the exhaust gas inlet opening 17 also help to facilitate expansion and contraction of the case member during use of the heat exchanger. The expansion joints 33 in the projections 21 that form the supply air inlet and discharge openings also assist in allowing the case member to expand and contract as necessary during the operation of the heat exchanger. The material used to form the case member 15 is also relatively close in thickness to the material to the material used to form the plate members 5 of the core 3. Because of the similarity in thickness of these materials used to form these components of the heat exchanger, there is a small mass differential between the core 3 and the case member 15 and a small differential in the rate of expansion and contraction of these components. The case member 15 is insulated from the jacket 39 and ambient air by the filler material 59. Since the case member is isolated from the ambient conditions, the case member is at substantially the same temperature as the core during the operation of the heat exchanger. Accordingly, the core 3 of the heat exchanger will expand and contract at substantially the same rate as the case member 15 expands and contracts. Thus, as the core expands or contracts the case member will expand and contract at substantially the same rate and accommodate the changes in size of the core. The expansion joint 29 in the case member and expansion joints 33 in the projections 21 also assist the case member in expanding and contracting as required to accommodate expansion and contraction in the core 3. Also, the corrugations in the plate members can help to accommodate any differential in expansion and contraction between the core 3 and the case member 15. As the case member expands, the filler material 59 may be compressed to accommodate this expansion.

The jacket 39 is isolated from the case member 15 and core 3 by the filler material 59. Accordingly, the jacket will not be exposed to the high temperatures from the exhaust gases passing through the core 3. Since the exterior of the jacket is exposed to the ambient air, this reduces the thermal gradient experienced by the jacket and reduces the expansion and contraction of the jacket. However, section 47 of the jacket 39 is positioned in abutting relationship with the portion of the case member 15 that is adjacent the exhaust gas discharge opening 19 and section 47 is secured to the case member. The flanges 51 of the jacket 39 are also positioned in abutting relationship with a portion of the projections 21 that is spaced apart from core 3 and the flanges are secured to the projections 21, as shown in FIG. 7. Thus, the section 47 and flanges 51 are in direct contact with the csae member 15 and heat will be transferred from the case member to these portions of the jacket 39. Since the section 47 is located at the exhaust gas discharge end of the heat exchanger where the temperatures of the exhaust gases are lower and the flanges 51 are located at the supply air inlet and discharge openings where the air temperatures are lower, there is less expansion and contraction present. However, since the thickness of the jacket is not much greater than the thickness of the case member, there is not a great difference in the expansion and contraction characteristics of the section 47 and the flanges 51 of the jacket 39 and the case member 15. Also the expansion joint 29 in the case member 15 and the expansion joints 33 in the projections 21 can assist in accommodating any differential in expansion and contraction.

The above description of the invention is given for the sake of explanation. Various modifications and substitutions can be made without departing from the scope of the invention as defined by the following claims.

What I claim is:

1. A recuperative heat exchanger comprising:

a heat exchanger core composed of a plurality of spaced apart plate members, said plate members being positioned in adjacent substantially parallel relationship a first plurality of passageways and a second plurality of passageways extending between said spaced apart plate members, said first plurality of passageways being separate from said second plurality of passageways, said first plurality of passageways in said core being disposed for receiving high temperature exhaust gases, said second plurality of passageways in said core being disposed for receiving supply air;

a case member having a top, two substantially parallel sides and a bottom positioned around said heat exchanger core, said case having an exhaust gas inlet opening and an exhaust gas discharge opening, said exhaust gas inlet opening and said exhaust gas discharge opening being in communication with said first plurality of passageways, said high temperature exhaust gases moving through said first plurality of passageways in said plates from said exhaust gas inlet opening to said exhaust gas discharge opening, said case member having a supply air inlet opening and a supply air discharge opening, said supply air inlet opening and supply air discharge opening being in communication with said second plurality of passageways, said supply air inlet and discharge openings being disposed to direct supply air through said second plurality of passageways in said core, said plates of said core being secured to said case at least at said exhaust gas inlet and discharge openings;

a jacket having a top, two substantially parallel sides and a bottom positioned in spaced apart relationship around said case member, said jacket having an intake opening and an exhaust opening, said intake opening in said jacket being in alignment with said exhaust gas inlet opening in said case member and said exhaust opening in said jacket being in alignment with said exhaust gas discharge opening in said case member, said supply air inlet and discharge openings passing through said jacket, said case member being rigidly secured to said jacket only at said end of said case where said exhaust gas discharge opening is located, said core and said case member being capable of expansion and contraction relative to said jacket during operation of said recuperative heat exchanger, whereby said core and said case member can expand and contract at a rate different than said jacket and said core and said case member can move relative to said jacket during such expansion and contraction to allow said heat exchanger to be used in high temperature applications.

2. The heat exchanger of claim 1, wherein said exhaust gas inlet opening is disposed in opposed substantially parallel relationship to said exhaust gas discharge opening.

3. The heat exchanger of claim 2, wherein said supply air inlet is positioned adjacent said exhaust gas discharge opening and said supply air discharge opening is positioned adjacent said exhaust gas inlet opening, said supply air inlet and discharge openings being disposed to direct supply air through said second plurality of passageways in said heat exchanger core, said supply air passing through said core in a direction substantially opposite to the direction of travel of said exhaust gasses passing through said core.

4. The heat exchanger of claim 1, wherein an expansion joint is positioned in said case member adjacent said exhaust gas inlet opening, said expansion joint allowing said case member to expand and contract in a direction parallel to the direction of flow of the exhaust gases through the heat exchanger.

5. The heat exchanger of claim 1 wherein said plate members in said core and said case member are formed from a high nickel alloy stainless steel.

6. The heat exchanger of claim 5 wherein said material of said case member has a thickness that is from about 1½ to about 3 times the thickness of said material of said plate members in said core, said thickness of said material of said case assisting in reducing the differential in expansion and contraction between said plate members and said case member.

7. The heat exchanger of claim 6 wherein the material of said jacket has a thickness that is from about 1½ to about 5 times the thickness of the material of said case member.

8. The heat exchanger of claim 1 wherein a deflector member is position on said intake opening in said jacket, said deflector member extending into said intake opening, said deflector member directing said exhaust gases into said first plurality of passageways defined by said plate member of said core.

9. A recuperative heat exchanger comprising:

a heat exchanger core composed of a plurality of spaced apart plate members, said plate members being positioned in adjacent substantially parallel relationship a first plurality of passageways and a second plurality of passageways extending between said spaced apart plate members, said first plurality of passageways being separate from said second plurality of passageways, said first plurality of passageways in said core being disposed for receiving high temperature exhaust gases, said second plurality of passageways in said core being disposed for receiving supply air;

a case member having a top, two substantially parallel sides and a bottom positioned around said heat exchanger core, said case having an exhaust gas inlet opening and an exhaust gas discharge opening, said exhaust gas inlet opening is disposed in opposed substantially parallel relationship to said exhaust gas discharge opening, said exhaust gas inlet opening and said exhaust gas discharge opening being in communication with said first plurality of passageways, said high temperature exhaust gases moving through said first plurality of passageways in said plates from said exhaust gas inlet opening to said exhaust gas discharge opening, said case member having a supply air inlet opening and a supply air discharge opening, said supply air inlet is positioned adjacent said exhaust gas discharge opening and said supply air discharge opening is positioned adjacent said exhaust gas inlet opening, said supply air inlet opening and supply air discharge opening being in communication with said second plurality of passageways, said supply air inlet and discharge openings being disposed to direct supply air through said second plurality of passageways in said core, said supply air passing through said core in a direction substantially opposite to the direction of travel of said exhaust gases passing through said core, said plates of said core being secured to said case at least at said exhaust gas inlet and discharge openings;

a jacket having a top, two substantially parallel sides and a bottom positioned in spaced apart relationship around said case member, said jacket having an intake opening and an exhaust opening, said intake opening in said jacket being in alignment with said exhaust gas inlet opening in said case member and said exhaust opening in said jacket being in alignment with said exhaust gas discharge opening in said case member, said supply air inlet and discharge openings passing through said jacket, said case member being secured to said jacket at said end of said case where said exhaust gas discharge opening is located, said core and said case member being capable of expansion and contraction relative to said jacket during operation of said recuperative heat exchanger, whereby said core and said case member can expand and contract at a rate different than said jacket and said core and said case member can move relative to said jacket during such expansion and contraction to allow said heat exchanger to be used in high temperature applications; and, projections extend from said case member in a direction away from said core, said projections defining a first passageway and a second passageway, said first passageway forming said supply air inlet opening and said second passageway defining said discharge opening, said projections extending through openings in said jacket.

10. The heat exchanger of claim 9, wherein said supply air inlet and discharge openings are positioned substantially perpendicular to said exhaust gas inlet and discharge openings.

11. The heat exchanger of claim 10, wherein an expansion joint is positioned around the periphery of said projections that extend from said case member to form said supply air inlet and discharge openings include an expansion joint that allows said projections to expand and contract in a direction substantially parallel to the flow of supply air through said projections during the operation of said heat exchanger.

12. The heat exchanger of claim 11, wherein said expansion joint in said projections that form said supply air inlet and discharge openings is at least one substantially semicircular groove that is positioned around the circumference of said projections of said case member, said groove allowing said projections to expand and contract during operation of said heat exchanger.

13. The heat exchanger of claim 12, wherein said expansion joint comprises two substantially semicircular grooves positioned around the circumference of said projections said grooves having a diameter from about $\frac{1}{4}$ of an inch to about 2 inches, said grooves being positioned in substantially parallel relationship to one another and said grooves being disposed substantially perpendicular to the flow of supply air through said projections that define said supply air inlet and discharge openings.

14. The heat exchanger of claim 13, wherein said jacket extends along at least a portion of said projections that define of said supply air inlet and discharge openings, said jacket being in spaced apart relationship with said projections.

15. The heat exchanger of claim 14, wherein a filler material is positioned between said case member and said jacket, said filler material acting to maintain a desired substantially uniform spacing between said case member and said jacket, said filler material also acting to insulate said jacket from said case member.

16. A recuperative heat exchanger comprising:

a heat exchanger core composed of a plurality of spaced apart plate members, said plate members being positioned in adjacent substantially parallel relationship, a first plurality of passageways and a second plurality of passageways extending between said spaced apart plate members, said first plurality of passageways being separate from said second plurality of passageways, said first plurality of passageways in said core being disposed for receiving high temperature exhaust gases, said second plurality of passageways in said core being disposed for receiving supply air;

a case member having a top, two substantially parallel sides and a bottom positioned around said heat exchanger core, said case having an exhaust gas inlet opening and an exhaust gas discharge opening, said exhaust gas inlet opening and said exhaust gas discharge opening being in communication with said first plurality of passageways, said high temperature exhaust gases moving through said first plurality of passageways in said plates from said exhaust gas inlet opening to said exhaust gas discharge opening, said case member having a supply air inlet opening and a supply air discharge opening, said supply air inlet opening and supply air discharge opening being in communication with said second plurality of passageways, said supply air inlet and discharge openings being disposed to direct supply air through said second plurality of passageways in said core, said plates of said core being secured to said case at least at said exhaust gas inlet and discharge openings;

an expansion joint positioned in said case member adjacent said exhaust gas inlet opening, said expansion joint being a substantially semicircular groove positioned around the periphery of said case member, said groove being disposed substantially perpendicular to the direction of flow of said exhaust gases through said heat exchanger core, said groove having a diameter from about ¼ of an inch to about 2 inches, said expansion joint allowing said case member to expand and contract in a direction parallel to the direction of flow of the exhaust gases through the heat exchanger, a jacket having a top, two substantially parallel sides and a bottom positioned in spaced apart relationship around said case member, said jacket having an intake opening and an exhaust opening, said intake opening in said jacket being in alignment with said exhaust gas inlet opening in said case member and said exhaust opening in said jacket being in alignment with said exhaust gas discharge opening in said case member, said supply air inlet and discharge openings passing through said jacket, said case member being secured to said jacket at said end of said case where said exhaust gas discharge opening is located, said core and said case member being capable of expansion and contraction relative to said jacket during operation of said recuperative heat exchanger whereby said core and said case member can expand and contract at a rate different than said jacket and said core and said case member can move relative to said jacket during such expansion and contraction to allow said heat exchanger to be used in high temperature applications.

17. The heat exchanger of claim 16 wherein said expansion joint in said case member extends along said bottom and two sides of said case member to form a substantially U-shaped expansion joint.

18. The heat exchanger of claim 17 wherein said portion of said expansion joint positioned along said sides of said case member converges as said expansion joint approaches said top of said case member.

19. A high temperature recuperative heat exchanger comprising:

a heat exchanger core composed of a plurality of spaced apart plate member, said plate member being made of a high nickel allow stainless steel, said plate members being positioned in adjacent substantially parallel relationship, a first plurality of passageways and a second plurality of passageways extending between said spaced apart plate members, said first plurality of passageways being separate from said second plurality of passageways, said first plurality of passageways being disposed for receiving high temperature exhaust gases, said second plurality of passageways being disposed for receiving supply air;

a case member having a top, two substantially parallel sides and a bottom positioned around said heat exchanger core, said case member being made of a high nickel alloy stainless steel, said case member having an exhaust gas inlet opening and an exhaust gas discharge opening, said exhaust gas inlet and discharge opening being in opposed substantially parallel relationship and being in communication with said first plurality of passageways defined by said plate members, said first plurality of passageways extending from said exhaust gas inlet opening to said exhaust gas discharge opening, said high temperature exhaust gases moving through said first plurality of passageways from said exhaust gas inlet opening to said exhaust gas discharge opening, said plate members of said core being secured to said case member at least at said exhaust gas inlet and discharge openings;

two projections extending from one side of said case member, said projections extending from case member in a direction away from said core, said projections each defining a passageway, one of said projections defining a supply air inlet opening and said other projection defining a supply air discharge opening, said supply air inlet opening being positioned adjacent said end of said case member having said exhaust discharge opening and said supply air discharge opening being positioned adjacent said end of said case member having said exhaust gas inlet opening, said supply air inlet and discharge openings being in communication with said second plurality of passageways in said core, said supply air inlet and discharge openings being disposed to direct supply air through said second plurality of passageways, said supply air passing through said second plurality of passageways in a direction substantially opposite to the direction of travel of said exhaust gases passing through said first plurality of passageways;

a jacket having a top, two substantially parallel sides and a bottom positioned in spaced apart relationship around said case member, said jacket having two openings to receive said projections that extend from said case member, said jacket having an extension that is positioned in spaced apart relationship around a portion of said projections and a flange connected to said extension, said flange extending in abutting relationship along a portion of said projection that is spaced apart from said case member, said flange being secured to said case member, said jacket having an intake opening and an exhaust opening, said intake opening in said jacket being in alignment with said exhaust gas inlet opening in said case member and said exhaust opening in said jacket being in alignment with said exhaust gas discharge opening in said case member, said jacket having a section that forms said discharge opening, said section being positioned in abutting relationship along a portion of said case member, said case member being secured to said section of said jacket at said discharge opening, said core and said case member being capable of expanding and contracting relative to said jacket during operation of said recuperative heat exchanger, whereby said core and said case member can expand and contract at a rate different than said jacket and said core and said case member can move relative to said jacket during such expansion and contraction to allow said heat exchanger to be used in high temperature applications;

a filler material positioned between said case member and said jacket, said filler material being a high density fibrous material, said filler material acting to maintain a desired uniform spacing between said case member and said jacket and to insulate said jacket from said case member.

20. The heat exchanger of claim 19 wherein said case member is made of a material having a thickness from about 1½ to about 3 times the thickness of the material of said plate member and the material of said jacket has a thickness from about 1½ to about 5 times the thickness of the material of said case member, said plate members, case member and jacket being made of the same type of stainless steel.

21. The heat exchanger of claim 19 wherein at least one expansion joint is positioned on said projections of said case member, said expansion joint being a substantially semicircular groove that is positioned around the periphery of said projections, said groove having a diameter from about ¼ of an inch to about 2 inches, said groove being disposed substantially perpendicular to the flow of supply air through said projections, said expansion joint in said projections allowing said projections to expand and contract in a direction substantially parallel to the flow of supply air through said projections during operation of said heat exchanger.

22. The heat exchanger of claim 21 wherein said two substantially parallel expansion joints are positioned on said projections.

23. The heat exchanger of claim 19 wherein an expansion joint is positioned in said case member adjacent said exhaust gas inlet opening, said expansion joint being a substantially semicircular groove positioned around the periphery of said case member, said groove being disposed substantially perpendicular to the direction of flow of said exhaust gases through said core, said groove having a diameter from about ¼ of an inch to about 2 inches, said expansion joint allowing said case member to expand and contract in a direction substantially parallel to the flow of exhaust gases through said core of said heat exchanger.

24. The heat exchanger of claim 23 wherein said expansion joint along the bottom of said jacket adjacent said projection defining said supply air discharge opening and extending along said sides of said jacket adjacent said bottom of said jacket, said expansion joint having a substantially U-shaped configuration.

25. The heat exchanger of claim 24 wherein said expansion joint along said sides of said jacket converges as said expansion joint moves away from said bottom of said jacket, said expansion joint terminating at said top of said jacket.

26. The heat exchanger of claim 19 wherein a deflector member is positioned on said intake opening in said jacket, said deflector member extending into said intake opening, said deflector member directing said exhaust gases into said first plurality of passageways defined by said plate members of said core, said deflector covering said filler material positioned between said case member and said jacket at said intake opening.

27. A high temperature recuperative heat exchanger comprising:

a heat exchanger core being composed of a plurality of spaced apart plate members, said plate members being positioned in adjacent substantially parallel relationship, said plate member being made of a high nickel alloy stainless steel, a first plurality of passageways and a second plurality of passageways extending between said spaced apart plate members, said first plurality of passageways being separate from said second plurality of passageways, said first plurality of passageways being disposed for receiving high temperature exhaust gases, said second plurality of passageways being disposed for receiving supply air;

a case member having a top, two substantially parallel sides and a bottom positioned around said heat exchanger core, said case member being made of a high nickel alloy stainless steel, said case member having an exhaust gas inlet opening and an exhaust gas discharge opening, said exhaust gas inlet and discharge openings being in opposed substantially parallel relationship and being in communication with said first plurality of passageways defined by said plate members, said first plurality of passageways extending from said exhaust gas inlet opening to said exhaust gas discharge opening, said high temperature exhaust gases moving through said first plurality of passageways from said exhaust gas inlet opening to said exhaust gas discharge opening, said plate members of said core being secured to said case member at least at said exhaust gas inlet and discharge openings, said stainless steel of said case member having a thickness that is from about 1½ to about 3 times the thickness of the stainless steel of said plate members;

an expansion joint positioned in said case member adjacent said exhaust gas inlet opening, said expansion joint being a substantially semicircular groove positioned around the periphery of said case member, said groove being disposed substantially perpendicular to the direction of flow of said exhaust gases through said core, said groove having a diameter from about ¼ of an inch to about 2 inches, said expansion joint allowing said case member to expand and contract in a direction substantially parallel to the flow of exhaust gases through said core of said heat exchanger;

two projections extending from one side of said case member, said projections extending from case member in a direction away from said core, said projections each defining a passageway and being made of the same material as said case member, one of said projections defining a supply air inlet opening and said other projection defining a supply air discharge opening, said supply air inlet opening being positioned adjacent said end of said case member having said exhaust discharge opening and said supply air discharge opening being positioned adjacent said end of said case member having said exhaust gas inlet opening, said supply air inlet and discharge openings being in communication with said second plurality of passageways in said core, said supply air inlet and discharge openings being disposed to direct supply air through said second plurality of passageways, said supply air passing through said second plurality of passageways in a direction substantially opposite to the direction of travel of said exhaust gases passing through said first plurality of passageways;

at least one expansion joint positioned on said projections of said case member, said expansion joint being a substantially semicircular groove that is positioned around the periphery of said projections, said groove having a diameter from about ¼ of an inch to about 2 inches, said groove being disposed substantially perpendicular to the flow of supply air through said projections, said expansion joint in said projections allowing said projections to expand and contract in a direction substantially parallel to the flow of supply air through said projections during operation of said heat exchanger;

a jacket having a top, two substantially parallel sides and a bottom positioned in spaced apart relationship around said case member, said jacket being made of a high nickel alloy stainless steel, said material of said jacket having a thickness that is from about 1½ to about 5 times the thickness of the stainless steel of said case member, said jacket having two openings to receive said projections that extend from said case member, said jacket having an extension that is positioned in spaced apart relationship around a portion of said projections and a flange connected to said extention, said flange extending in abutting relationship along a portion of said projection that is spaced apart from said case member, said flange being secured to said case member, said jacket having an intake opening and an exhaust opening, said intake opening in said jacket being in alignment with said exhaust gas inlet opening in said case member and said exhaust opening in said jacket being in alignment with said exhaust gas discharge opening in said case member, said jacket having a section that forms said discharge opening, said section being positioned in abutting relationship along a portion of said case member, said case member being secured to said section of said jacket at said discharge opening, said core and said case member being capable of expanding and contracting relative to said jacket during operation of said recuperative heat exchanger, whereby said core and said case member can expand and contract at a rate different than said jacket and said core and case member can move relative to said jacket during such expansion and contraction to allow said heat exchanger to be used in high temperature applications;

a filler material positioned between said case member and said jacket, said filler material being a high density fibrous material, said filler material acting to maintain a desired uniform spacing between said case member and said jacket and to insulate said jacket from said case member;

a deflector member positioned on said intake opening in said jacket, said deflector member extending into said intake opening, said deflector member directing said exhaust gases into said first plurality of passageways defined by said plate members of said core, said deflector covering said filler material positioned between said case member and said jacket at said intake opening.

* * * * *